US008410699B2

(12) United States Patent
Yu

(10) Patent No.: US 8,410,699 B2
(45) Date of Patent: Apr. 2, 2013

(54) HEAT DISSIPATION ENHANCED LED LAMP

(76) Inventor: Chih-Ming Yu, Hsinchu (TW)

( * ) Notice: Subject to any disclaimer, the term of this patent is extended or adjusted under 35 U.S.C. 154(b) by 373 days.

(21) Appl. No.: 12/759,098

(22) Filed: Apr. 13, 2010

(65) Prior Publication Data

US 2010/0320903 A1 Dec. 23, 2010

Related U.S. Application Data

(63) Continuation-in-part of application No. 12/457,718, filed on Jun. 19, 2009.

(51) Int. Cl.
*H01J 7/44* (2006.01)
*H01J 17/34* (2006.01)

(52) U.S. Cl. ..... 315/32; 315/46

(58) Field of Classification Search ..... 315/32, 315/46, 48, 49, 50, 59, 115–117, 246; 362/257, 362/580, 294, 126
See application file for complete search history.

(56) References Cited

U.S. PATENT DOCUMENTS

| | | | | |
|---|---|---|---|---|
| 6,957,901 | B2 * | 10/2005 | Schach et al. | 362/489 |
| 7,296,913 | B2 * | 11/2007 | Catalano et al. | 362/257 |
| 7,566,912 | B2 * | 7/2009 | Lee et al. | 257/98 |
| 7,883,242 | B2 * | 2/2011 | Ng et al. | 362/249.06 |
| 2001/0012200 | A1 * | 8/2001 | Edwards et al. | 361/760 |
| 2002/0126491 | A1 * | 9/2002 | Chen | 362/363 |
| 2008/0224849 | A1 * | 9/2008 | Sirhan | 340/521 |

* cited by examiner

*Primary Examiner* — Minh D A

(57) ABSTRACT

A LED lamp which could directly replace an ordinary tungsten, halogen, or electricity-saving light bulb, includes a LED filament, a lamp base, a thermally conductive electric insulator, and a mask. The thermally conductive electric insulator is filled in a cavity of the lamp base, and includes a first portion mechanically contacting the LED filament and an electrode of the lamp base to provide a first thermal channel from the LED filament to the lamp base, and a second portion adhering the mask to the lamp base to provide a second thermal channel from the lamp base to the mask. By using the mask to enlarge the heat dissipation area, a better heat dissipation effect is achieved.

19 Claims, 14 Drawing Sheets

HEAT DISSIPATION ENHANCED LED LAMP

CROSS REFERENCE TO RELATED APPLICATION

This application is a continuation-in-part of U.S. patent application Ser. No 12/457,718, filed Jun. 19, 2009 and entitled "Heat Dissipation Enhanced LED Lamp," the disclosure of which is hereby incorporated by reference as if set forth fully herein.

FIELD OF THE INVENTION

The present invention is related generally to electric lamps and, more particularly, to a LED lamp which could directly replace an ordinary tungsten, halogen, or electricity-saving light bulb.

BACKGROUND OF THE INVENTION

A light emitting diode (LED) lamp using a direct-current (DC) LED device as the filament must be equipped with a power converter for converting the alternating-current (AC) power voltage into a DC input voltage for the DC LED device. The power converter not only requires additional component cost for the LED lamp, but also cannot fit entirely into the standard lamp bases of ordinary light bulbs. For a LED lamp to be equipped with a power converter, it is necessary to develop special molds to produce containers and corresponding mechanism different from those of ordinary light bulbs to fit the power converter therewithin, which nevertheless increases the cost and volume of the LED lamp. On the other hand, a DC LED device generates heat when it is powered on and therefore, an additional heat dissipation mechanism is required to handle the heat. If the heat is not effectively dissipated, the resulting high temperature will reduce the emissive efficiency and service life of the DC LED device and produce other adverse effects such as wavelength shift. Moreover, the power converter, particularly the inductor and integrated circuit therein, also generates heat during power conversion, and the consequent high temperature may damage the inductor and integrated circuit and cause failure of the LED lamp accordingly. The problems caused by insufficient heat dissipation are aggravated especially in high power applications, such as in lighting fixtures for illumination purposes, where the DC LED device generates relatively more heat. To adapt to the relatively small space within ordinary lamp bases, some LED lamps use a plurality of low power lamp type LED devices in conjunction with a simple bridge rectifier circuit. However, low power LED devices are poorly accepted in the market due to their generally low brightness, and these LED lamps tend to have serious light attenuation problems as a result of poor heat dissipation.

In recent years, AC LED devices are maturing technically, have improved in brightness, and therefore have had commercial value. An AC LED device includes a plurality of serially and/or parallel connected LED electronic elements manufactured on an epitaxial chip. The epitaxial chip is packaged and then connected in series with a resistor having a particular resistance so as to withstand high voltage, e.g., 110 V or 220 V, mains electricity, thus dispensing with the power converter or rectifier circuit required for a DC LED device. In consequence, the cost of an AC LED lamp is lowered in comparison with its DC counterpart, and the circuit related quality issues reduced. An AC LED device, though conveniently applicable in small spaces, still demands heat dissipation. This is especially true in high power applications, such as lighting fixtures for illumination purposes, where the AC LED device generates relatively more heat. If a heat dissipating device is added, the resultant LED lamp will be bulky and costly. However, if no additional assistance is provided to enhance heat dissipation from the AC LED device, the emissive efficiency and service life of the AC LED device will be reduced, wavelength shift is likely to happen, and even worse, the LED epitaxial chip may be burned out.

SUMMARY OF THE INVENTION

An object of the present invention is to provide a LED lamp which enhances the heat dissipation of the AC LED device in the LED lamp.

Another object of the present invention is to provide a higher output efficiency LED lamp.

Yet another object of the present invention is to provide a LED lamp which could directly replace an ordinary tungsten, halogen, or electricity-saving light bulb.

According to the present invention, a LED lamp includes a LED filament, a lamp base, a mask and a thermally conductive electric insulator. The LED filament includes at least an AC LED device, and the mask is fixed on the lamp base. The thermally conductive electric insulator is filled in a cavity of the lamp base, and thus includes a first portion mechanically contacting the LED filament and an electrode of the lamp base to provide a first thermal channel to transfer heat from the LED filament to the electrode of the lamp base, and a second portion mechanically contacting the electrode of the lamp base and the mask to provide a second thermal channel to transfer heat from the electrode of the lamp base to the mask. By adding the mask to enlarge the heat dissipation area, the heat dissipation effect becomes higher.

Preferably, the thermally conductive electric insulator further includes a third portion between the LED filament and the mask, so as to provide a third thermal channel to transfer heat from the LED filament to the mask for further heat dissipation enhancement. Preferably, the third portion of thermally conductive electric insulator has a white upper surface to increase the light output efficiency.

Standard lamp bases for ordinary light bulbs can be selected for the lamp base of a LED lamp according to the present invention, and thus the LED lamp could be inserted into the ordinary bulb sockets that generally used in lighting fixtures, without having to modify the system of the lighting fixtures or use an additional adapter.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
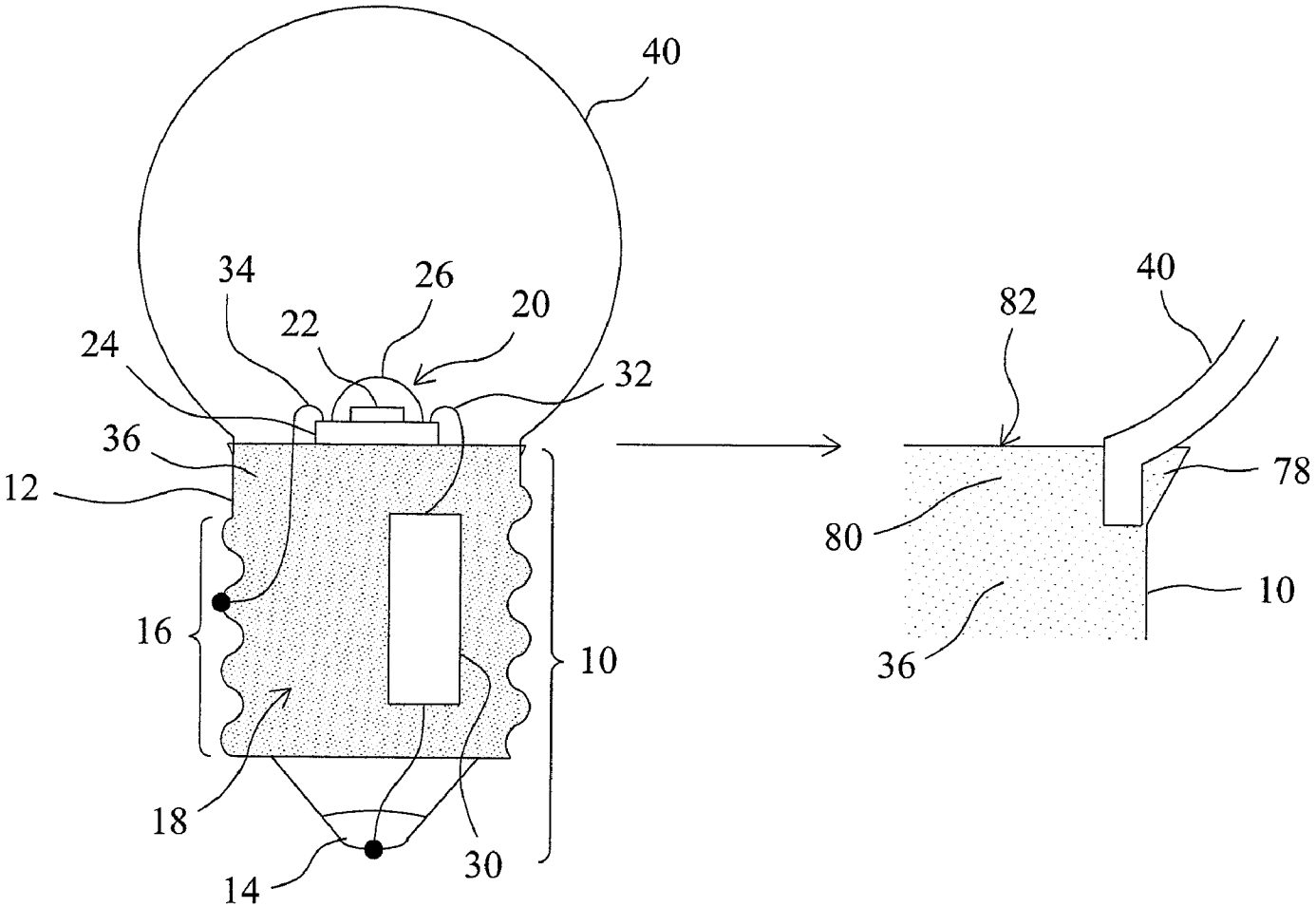
FIG. 1 is a cross-sectional view of a first embodiment according to the present invention.
Figure 2:
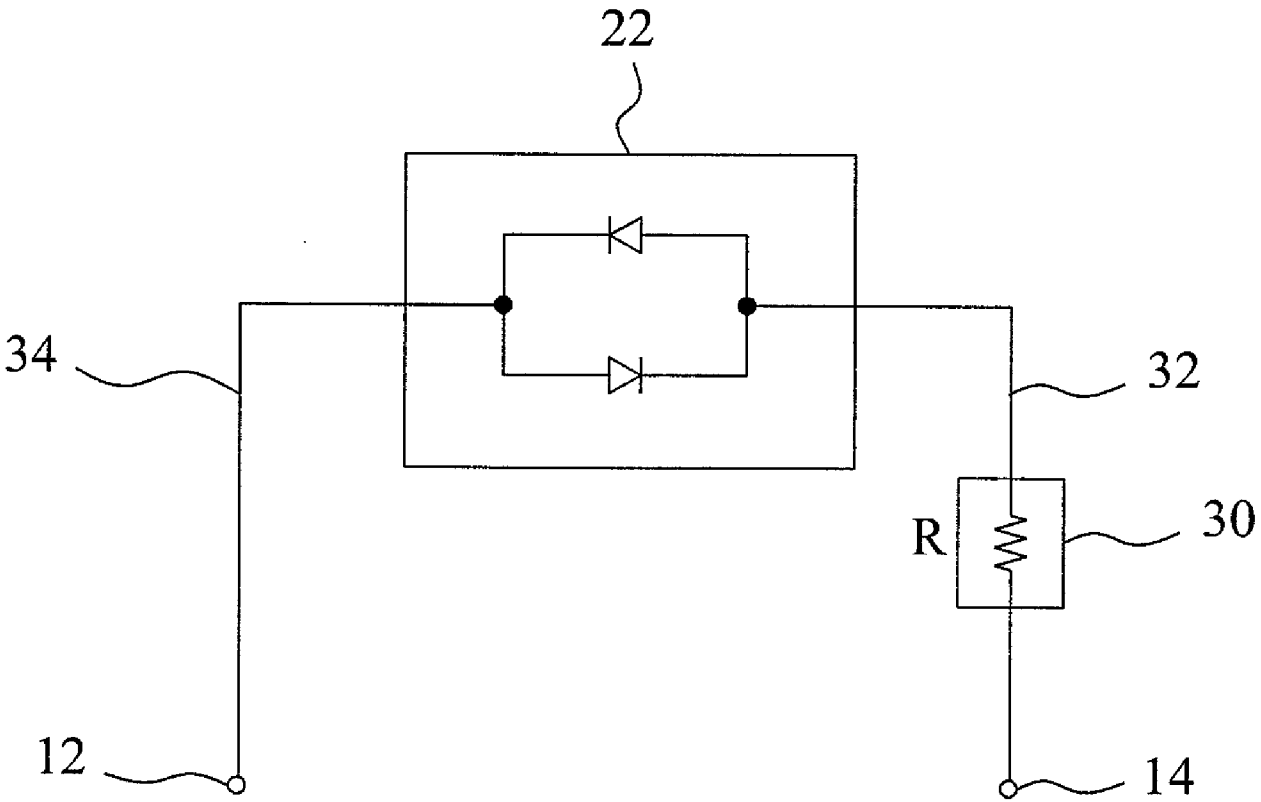
FIG. 2 shows an equivalent circuit of the LED lamp depicted in FIG. 1.

FIG. 1 provides a first embodiment according to the present invention, in which a standard lamp base 10 for use with a small light bulb is used to accentuate the features of the present invention. The lamp base 10 has two electrodes 12 and 14 for receiving an AC power source. As would be understood by a person of ordinary skill in the art, the electrode 12 is a metal housing having a spiral-threaded configuration 16 and a cavity 18 therein. In this embodiment, an AC LED device 20 is used as the filament of the LED lamp, which includes an AC LED epitaxial chip 22 bounded on a leadframe 24 and covered with an encapsulant 26. As the LED packaging is well-known, the package structure of the AC LED device 20 is not detailed in the drawing for the sake of simplicity. A resistor 30 has one end soldered to the electrode 14 and its opposite end connected to a wire 32 that is soldered to the AC LED device 20. Another wire 34 has its two ends soldered to the electrode 12 and the AC LED device 20, respectively. This LED lamp has the equivalent circuit shown in FIG. 2, in which the AC LED epitaxial chip 22 and the resistor 30 are connected in series between the electrodes 12 and 14. As would be understood by a person of ordinary skill in the art, a so-called AC LED epitaxial chip includes LEDs oriented in two opposite directions and connected in parallel between two pins, with at least one LED in each direction. The LEDs oriented in the two opposite directions are lit during the positive and negative half cycles of an AC power source, respectively. The resistor 30 has a resistance R chosen according to the current intensity required by design. The resistor 30 also serves to protect the AC LED epitaxial chip 22. More specifically, when a surge occurs in the AC power source connected to the electrodes 12 and 14, the resistor 30 will absorb most of the surge voltage. Referring back to FIG. 1, a major feature of the present invention is to fill the cavity 18 with a thermally conductive electric insulator 36 in mechanical contact with the electrode 12 and the LED filament, i.e. the leadframe 24 in this case, to provide a first thermal channel to transfer the heat generated by the AC LED epitaxial chip 22 to the electrode 12 when the AC LED epitaxial chip 22 is powered on to emit light, thereby enhancing the heat dissipation therefrom. As would be understood by a person of ordinary skill in the art, the leadframe 24 typically includes a metal plate for facilitating heat dissipation from the AC LED epitaxial chip 22. Therefore, by attaching the leadframe 24 to the thermally conductive electric insulator 36, good thermal conduction effect can be achieved. In addition to enhance the heat dissipation from the AC LED epitaxial chip 22, the thermally conductive electric insulator 36 also assists in heat dissipation from the resistor 30 because the resistor 30 is buried therein. As shown in the right of FIG. 1, the thermally conductive electric insulator 36 further includes a second portion 78 to adhere a mask 40 to the lamp base 10 and thus provide a second thermal channel to transfer heat from the lamp base 10 to the mask 40, and a third portion 80 between the LED filament and the mask 40 to provide a third thermal channel to transfer heat from the LED filament to the mask 40. Therefore, by using the mask 40 to enlarge the heat dissipation area, better heat dissipation effect is achieved. Preferably, the third portion 80 of the thermally conductive electric insulator 36 has a white upper surface 82, which may reduce the absorption of light and increase reflection the light, thereby increasing the light output of the LED lamp.

For the thermally conductive electric insulator 36, it may select epoxy resin, or thermal conductor powder such as aluminum oxide, aluminum nitride, boron nitride, or any other thermally conductive materials in powder form, or a mixture thereof. To form the white surface 82, it may coat white pigment on the third portion 80 of the thermally conductive electric insulator 36, or add powder of titanium dioxide into the thermally conductive electric insulator 36.

As shown in FIG. 1, the LED lamp according to the present invention has approximately the same size as the lamp base 10, possesses good heat dissipation ability, and is capable of high power applications that are unachievable by the prior art devices. Ordinary light bulbs are equipped with standard lamp bases. For example, lamp bases under the standards E12, E14, E17, E26 and E27 are for the ordinary tungsten light bulbs, and MR16 and GU10 lamp bases are for the ordinary halogen light bulbs. The lamp base of an ordinary halogen light bulb has an electrode formed as a columnar metal housing and separated from the other electrode by an electric insulator. Some other standard lamp bases use two needle-like electrodes that are insulated from each other. The lamp base for a LED lamp according to the present invention can be one of ordinary tungsten or halogen light bulbs or other standard lamp bases where there is always a cavity to be filled with the thermally conductive electric insulator 36, and in consequence at least one electrode serves to facilitate heat dissipation from the filament of the LED lamp. As the electrodes of standard lamp bases are exposed outside, fair heat dissipation effect is attainable.

Figure 3:
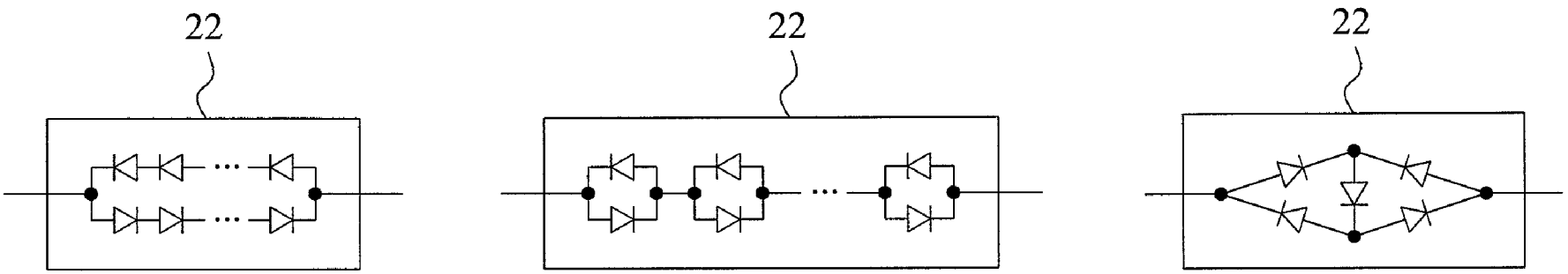
FIG. 3 provides three AC LED epitaxial chips.

An AC LED epitaxial chip including more than two LED electronic elements may be used for the AC LED epitaxial chip 22 to provide brighter illumination. FIG. 3 provides three such AC LED epitaxial chips 22. The first one in the left includes two LED strings parallel connected in opposite directions between two pins of the AC LED epitaxial chips 22, each LED string having two or more LED electronic elements. The second case in the middle includes two or more pairs of LED electronic elements serially connected between two pins of the AC LED epitaxial chips 22, each pair of LED electronic elements parallel connected in opposite directions to each other. The last case in the right includes five or more LED electronic elements having a bridge configuration between two pins of the AC LED epitaxial chips 22. There have been commercial products can be selected for these cases.

The lamp cover 40 also functions as a protective shell for preventing moisture, dust, or external force from affecting internal components of the LED lamp. Besides, the lamp cover 40 also serves as an optical component. More specifically, the lamp cover 40 may be frosted or configured with geometric patterns so as to produce the desired optical effects. The frosted structure of the lamp cover 40 can be formed by sand blasting, etching, electrostatic powder coating, coating with silicone, spraying with paint, or injection molding.

Figure 4:
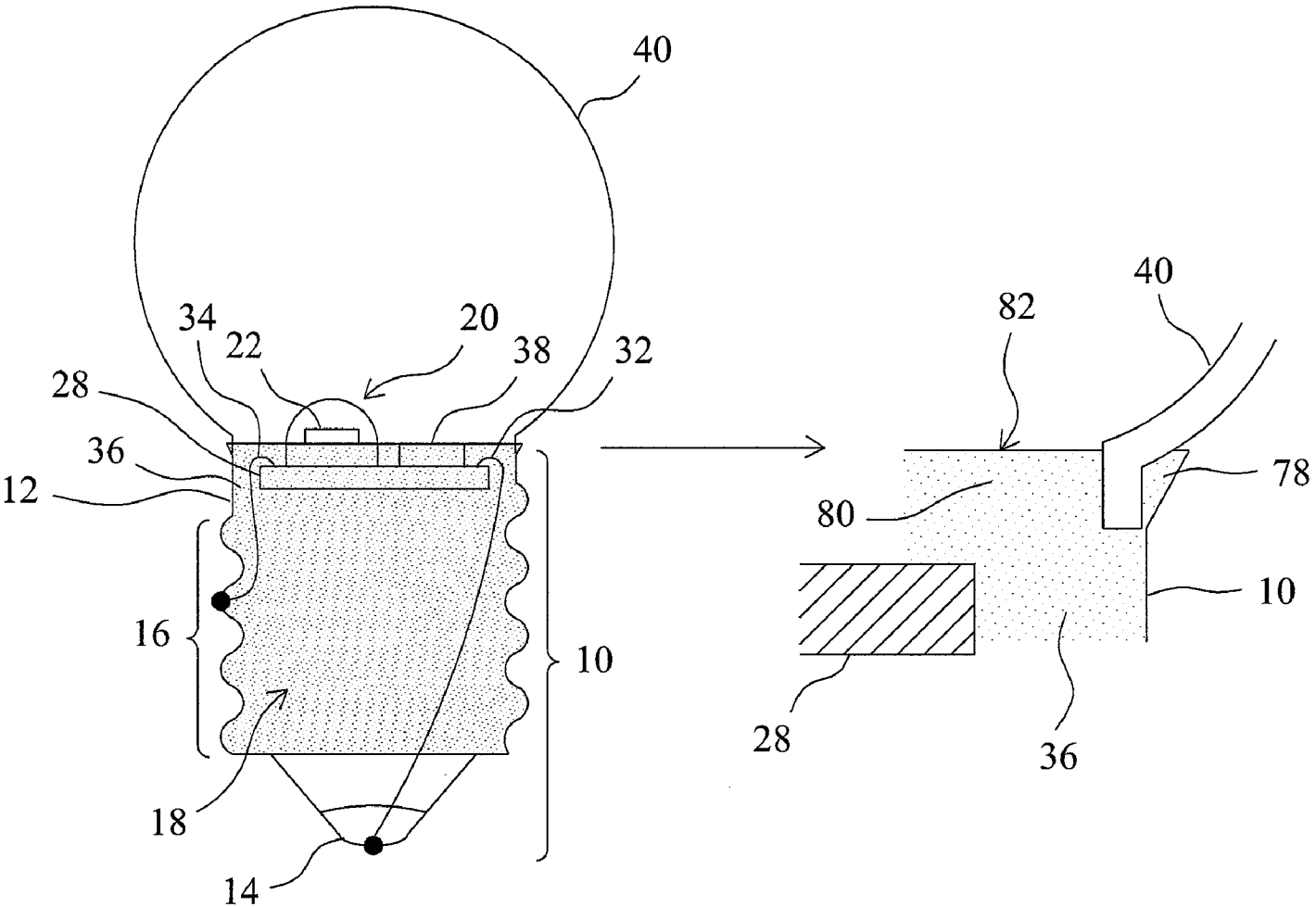
FIG. 4 is a cross-sectional view of a second embodiment according to the present invention.

FIG. 4 shows a second embodiment according to the present invention, in which the LED filament includes a circuit board 28 to be mounted with an AC LED device 20 thereon. The AC LED device 20 includes one or more AC LED epitaxial chips 22. A series resistor 38 is mounted on the circuit board 28, and wires 34 and 32 electrically connect the circuit board 28 to the electrodes 12 and 14, respectively. The circuit board 28 has a glass fiber reinforced substrate or a metal substrate, and the AC LED device 20 and the series resistor 38 may use surface mounting devices (SMDs) to be mounted on the circuit board 28 by surface mounting technology (SMT). Since the resistor 38 is mounted on the circuit board 28, it may use variable resistor device for more flexible applications, for example, conveniently to adjust the current of the AC LED device 20. The thermally conductive electric insulator 36 is filled as much as to cover the circuit board 28, so as to form the third portion 80 of the thermally conductive electric insulator 36, as shown in the right of FIG. 4. The other features are the same as those of the first embodiment shown in FIG. 1.

Figure 5:
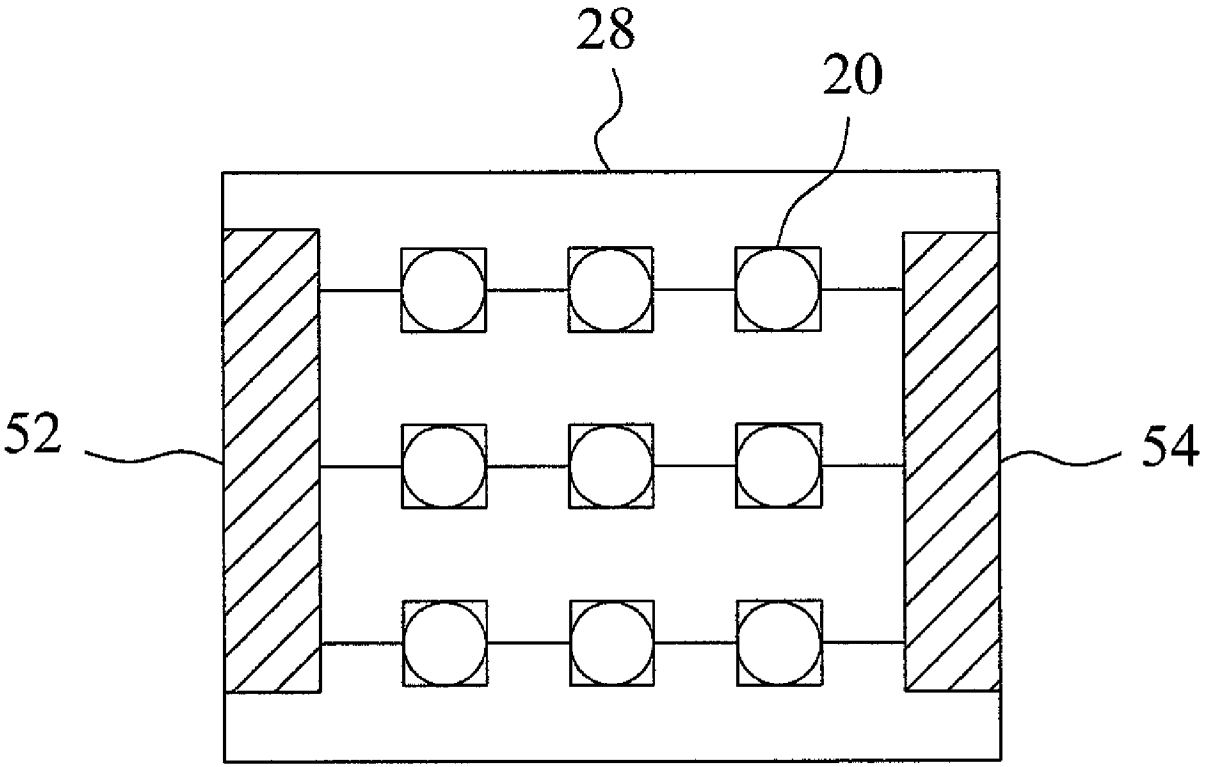
FIG. 5 is a top view of a LED filament using multiple LED epitaxial chips.

If it is desired to increase the brightness of a LED lamp, more AC LED devices 20 can be connected in series, in parallel, or in series and parallel in the filament. For example, as shown in FIG. 5, a LED filament includes nine AC LED devices 20 bounded on a circuit board 28 in such a manner that three rows of AC LED devices 20 are connected in parallel between solder pads 52 and 54 on the circuit board 28, and each row includes three AC LED devices 20. If each of the AC LED devices 20 operates at a power of 1 W, the filament shown in FIG. 5 can operate at a power as high as 9 W.

In either FIG. 4 or FIG. 5, the AC LED device 20 of the LED filament is attached on the circuit board 28; instead, in other embodiments, it may package the AC LED epitaxial chip 22 on the circuit board 28, by which the AC LED epitaxial chip 22 is directly attached on the circuit board 28, followed by wire bonding and molding of the encapsulant 26.

Figure 6:
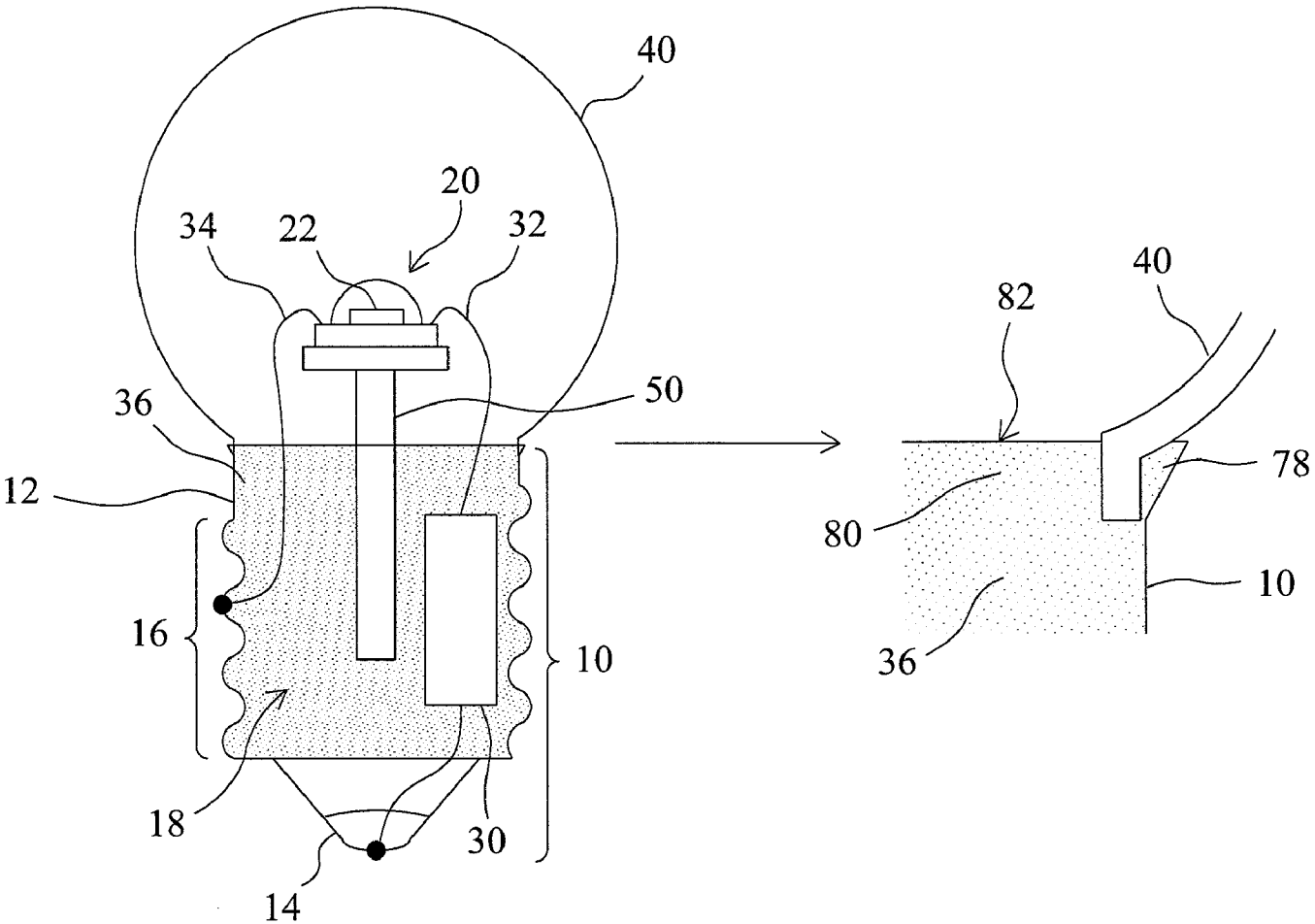
FIG. 6 is a cross-sectional view of a third embodiment according to the present invention.

FIG. 6 shows a third embodiment according to the present invention, in which the LED filament includes an AC LED device 20 and a thermally conductive member 50 having a dish at its upper end for the AC LED device 20 to be bounded thereon. Preferably, the lower end of the thermally conductive member 50 has a rod or strip shape. The lower end of the thermally conductive member 50 is buried in a thermally conductive electric insulator 36 filled in the cavity 18 of a lamp base 10, so that the thermally conductive electric insulator 36 provides a thermal channel for the LED filament to an electrode 12 of the lamp base 10. The height of the AC LED device 20 can be adjusted by adjusting the length of the thermally conductive member 50 into the thermally conductive electric insulator 36. Wires 32 and 34 electrically connect the AC LED device 20 to a resistor 30 and the electrode 12 of the lamp base 10, and the resistor 30 is electrically connected to the electrode 14 of the lamp base 10, such that the AC LED device 20 and the resistor 30 are serially connected between the electrodes 12 and 14 of the lamp base 10. The other features are the same as those of the first embodiment shown in FIG. 1.

Figure 7:
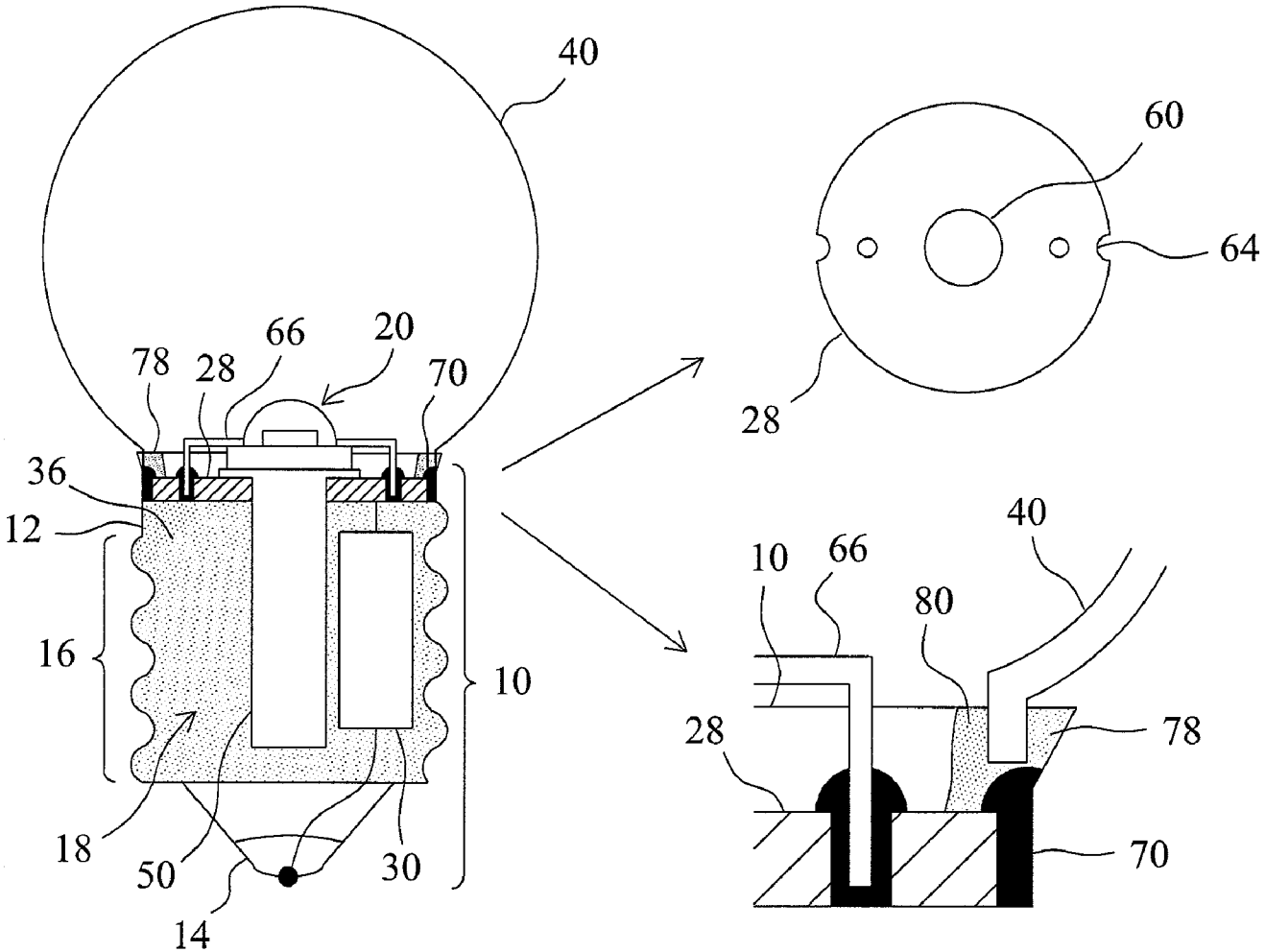
FIG. 7 is a cross-sectional view of a fourth embodiment according to the present invention.

FIG. 7 provides a fourth embodiment according to the present invention, in which a circuit board 28 has a through hole 60, a thermally conductive member 50 passes through the through hole 60 and has a first end above the circuit board 28 and a second end buried in a thermally conductive electric insulator 36, and an AC LED device 20 is bounded to the first end of the thermally conductive member 50. The AC LED device 20 has pins 66 soldered to the circuit board 28 which has through holes 64 to be soldered to an electrode 12 of the lamp base 10 by solders 70. A resistor 30 is soldered between an electrode 14 and the circuit board 28 such that the resistor 30 and the AC LED device 20 are connected in series between the electrodes 12 and 14. The circuit board 28 has a glass fiber reinforced substrate or a metal substrate. Preferably, the circuit board 28 is also in mechanical contact with the thermally conductive electric insulator 36. Alternatively, the resistor 30 is mounted on the circuit board 28. In some other embodiments, a second resistor is mounted on the circuit board 28 and connected with the first resistor 30 in series. As shown in the right of FIG. 7, the thermally conductive electric insulator 36 includes a second portion 78 to adhere a mask 40 to the lamp base 10 to transfer heat from the lamp base 10 to the mask 40. Preferably, the circuit board 28 has its upper surface coated with white pigment to increase the output light of the LED lamp. The other features are the same as those of the second embodiment shown in FIG. 4.

Figure 8:
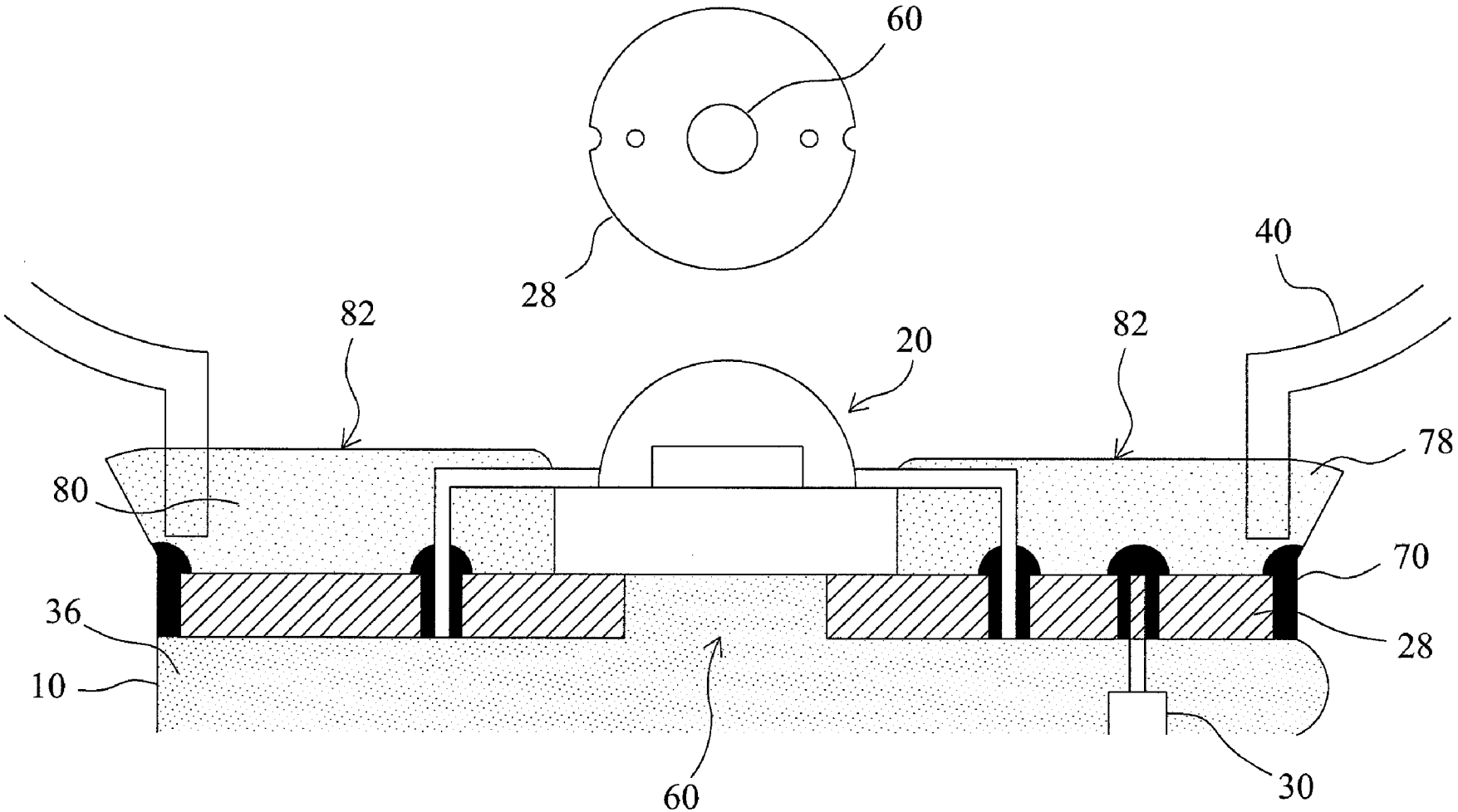
FIG. 8 is a cross-sectional view of a fifth embodiment according to the present invention.

FIG. 8 provides a fifth embodiment according to the present invention, in which a circuit board 28 having a through hole 60 is mounted with an AC LED device 20 thereon, a thermally conductive electric insulator 36 filled in a lamp base 10 includes a first portion mechanically contacting the circuit board 28 and the AC LED device 20 via the through hole 60, a second portion 78 adhering a mask 40 to the lamp base 10, and a third portion 80 covering on the upper surface of the circuit board 28, preferably as much as possible, except the region of the AC LED device 20. Preferably, the third portion 80 of the thermally conductive electric insulator 36 has white upper surface 82 to increase light output of the LED lamp. The other features are the same as those of the fourth embodiment shown in FIG. 7.

Figure 9:
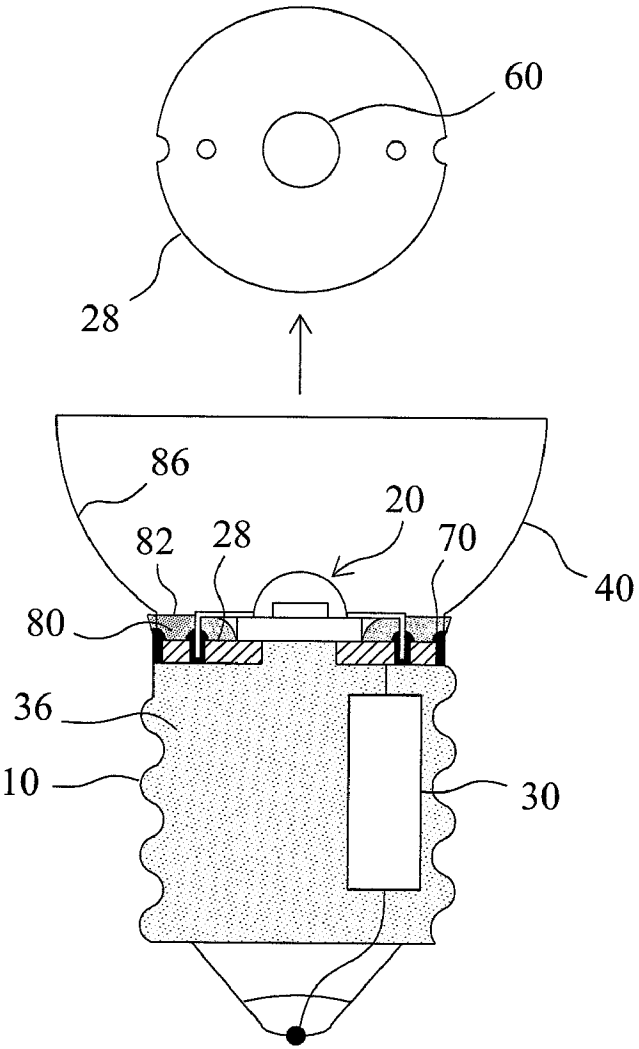
FIG. 9 is a cross-sectional view of a sixth embodiment according to the present invention.

The mask 40 in the LED lamp shown in FIG. 8 or any other embodiments may have a half-spherical shape, as shown in FIG. 9. The inner surface of the mask 40 may be plated with reflective film or coated with reflective material to form a reflective surface 86 thereon. The other features are the same as those of the fifth embodiment shown in FIG. 8.

Figure 10:
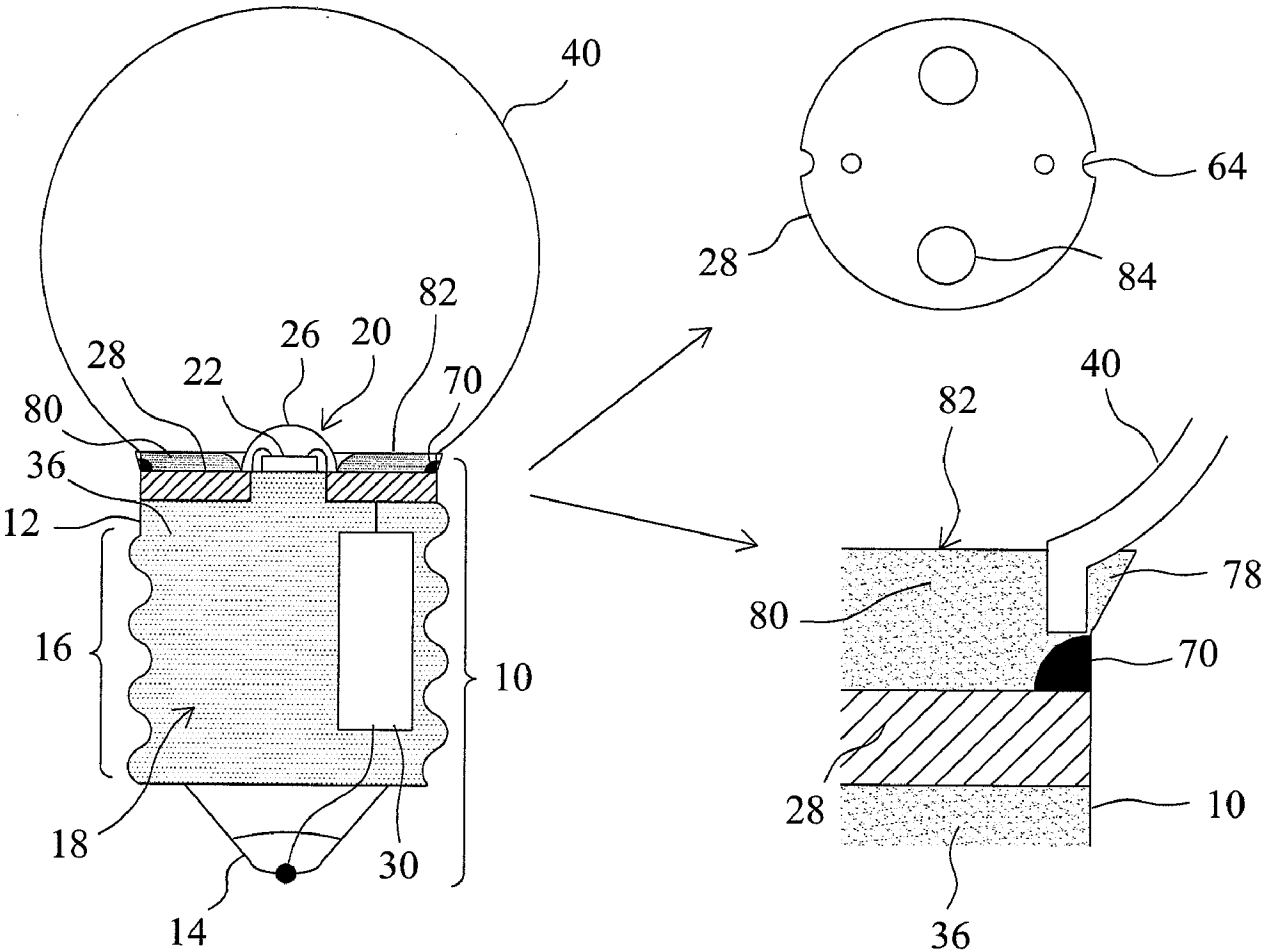
FIG. 10 is a cross-sectional view of a seventh embodiment according to the present invention.

FIG. 10 provides a seventh embodiment according to the present invention, in which the LED filament includes an AC LED device 20 mounted on a circuit board 28 with a chip-on-board (COB) package structure. The circuit board 28 has an aluminum metal layer, a copper metal layer, and a thermally conductive layer sandwiched therebetween, and this structure exhibits better heat dissipation capability than a glass fiber reinforced substrate. As shown in the right of FIG. 10, the circuit board 28 has through holes 84 to fill a thermally conductive electric insulator 36 into the cavity 18 of a lamp base 10, and through holes 64 to be soldered to an electrode 12 of the lamp base 10 by means of solder 70. A resistor 30 is connected between the circuit board 28 and an electrode 14 of the lamp base 10 and as a result, the AC LED device 20 and the resistor 30 are serially connected between the electrodes 12 and 14 to form an electric loop. Alternatively, the resistor 30 is mounted on the circuit board 28. In some other embodiments, a second resistor is mounted on the circuit board 28 and serially connected to the first resistor 30. As shown in the right of FIG. 10, the thermally conductive electric insulator 36 has a second portion 78 to adhere a mask 40 to the lamp base 10 and provide a second thermal channel to transfer heat from the lamp base 10 to the mask 40. The thermally conductive electric insulator 36 is filled as much as to form a third portion 80 covering the upper surface of the circuit board 28 to provide a third thermal channel from the AC LED device 20 to the mask 40 for further heat dissipation enhancement, and preferably, the third portion 80 of the thermally conductive electric insulator 36 has a white upper surface 82 to increase the light output of the LED lamp. The other features are the same as those of the fifth embodiment shown in FIG. 8.

Figure 11:
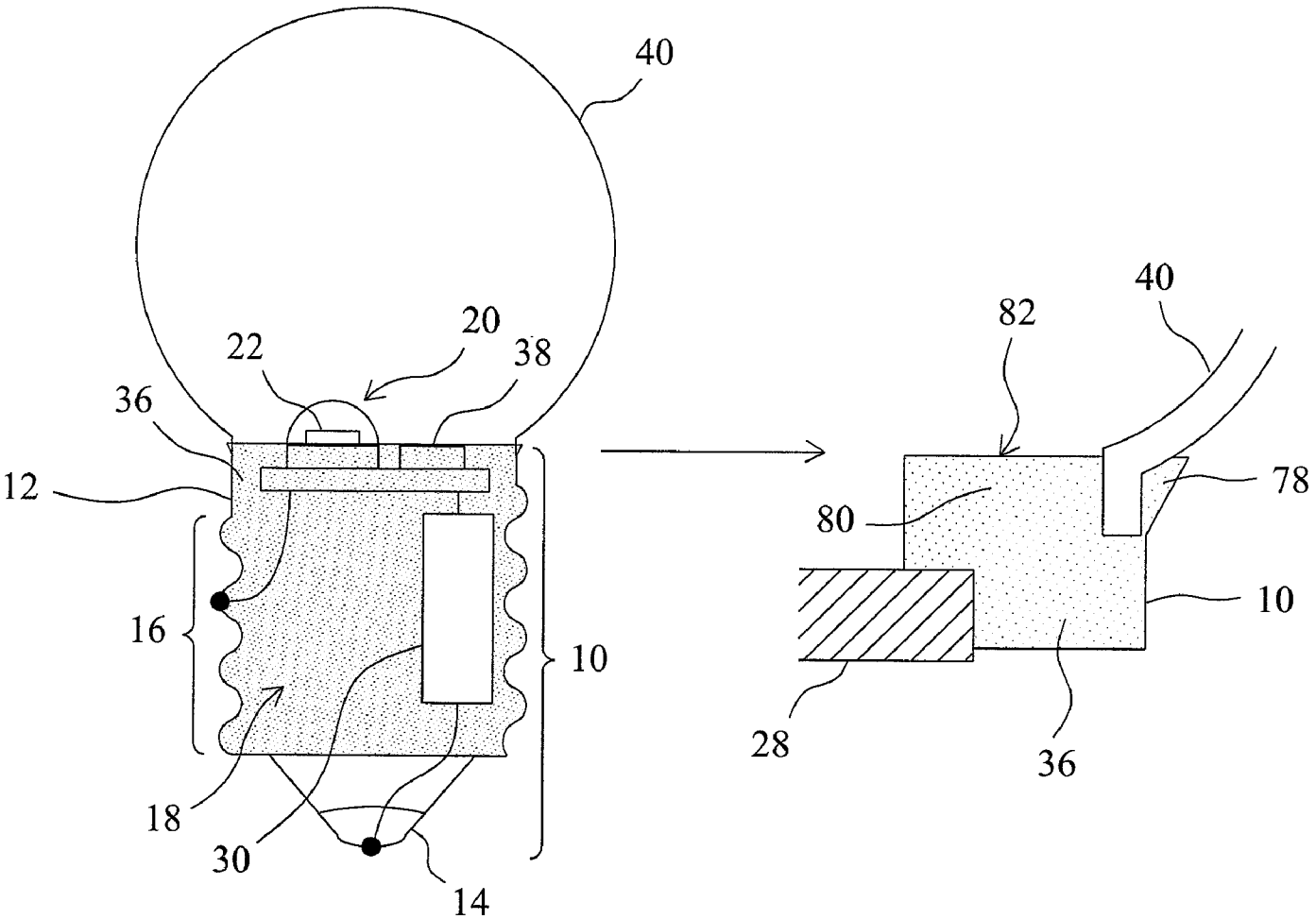
FIG. 11 is a cross-sectional view of an eighth embodiment according to the present invention.

As shown in FIG. 11, in addition to a resistor 30 in the cavity 18 of a lamp base 10, another resistor 38 is mounted on a circuit board 28 and electrically connected between the resistor 30 and an AC LED device 20. The resistor 38 may use a variable resistor device to adjust the resistance thereof depending on demand. The other features are the same as those of the second embodiment shown in FIG. 4.

Figure 12:
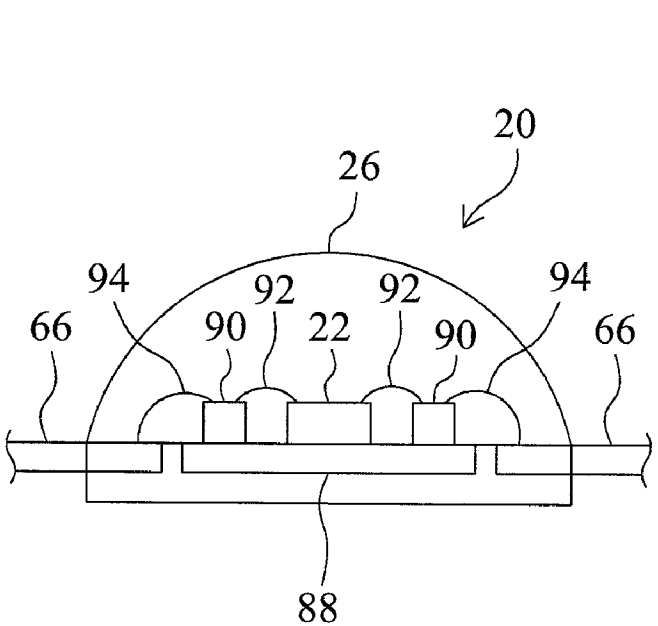
FIG. 12 is a diagram showing a structure of packaging an AC LED epitaxial chip with chip resistors in a same package.
Figure 12:
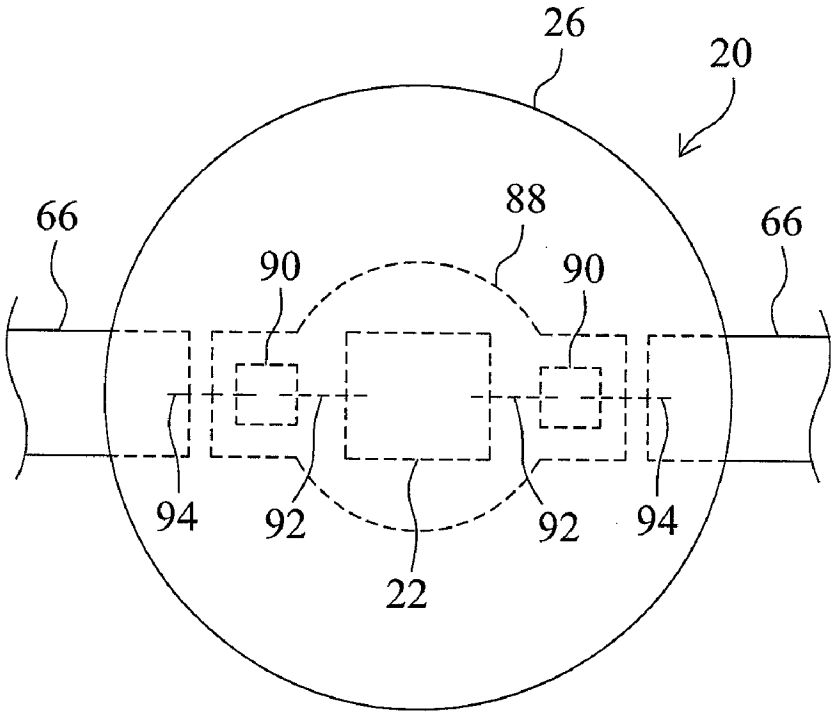
Figure 13:
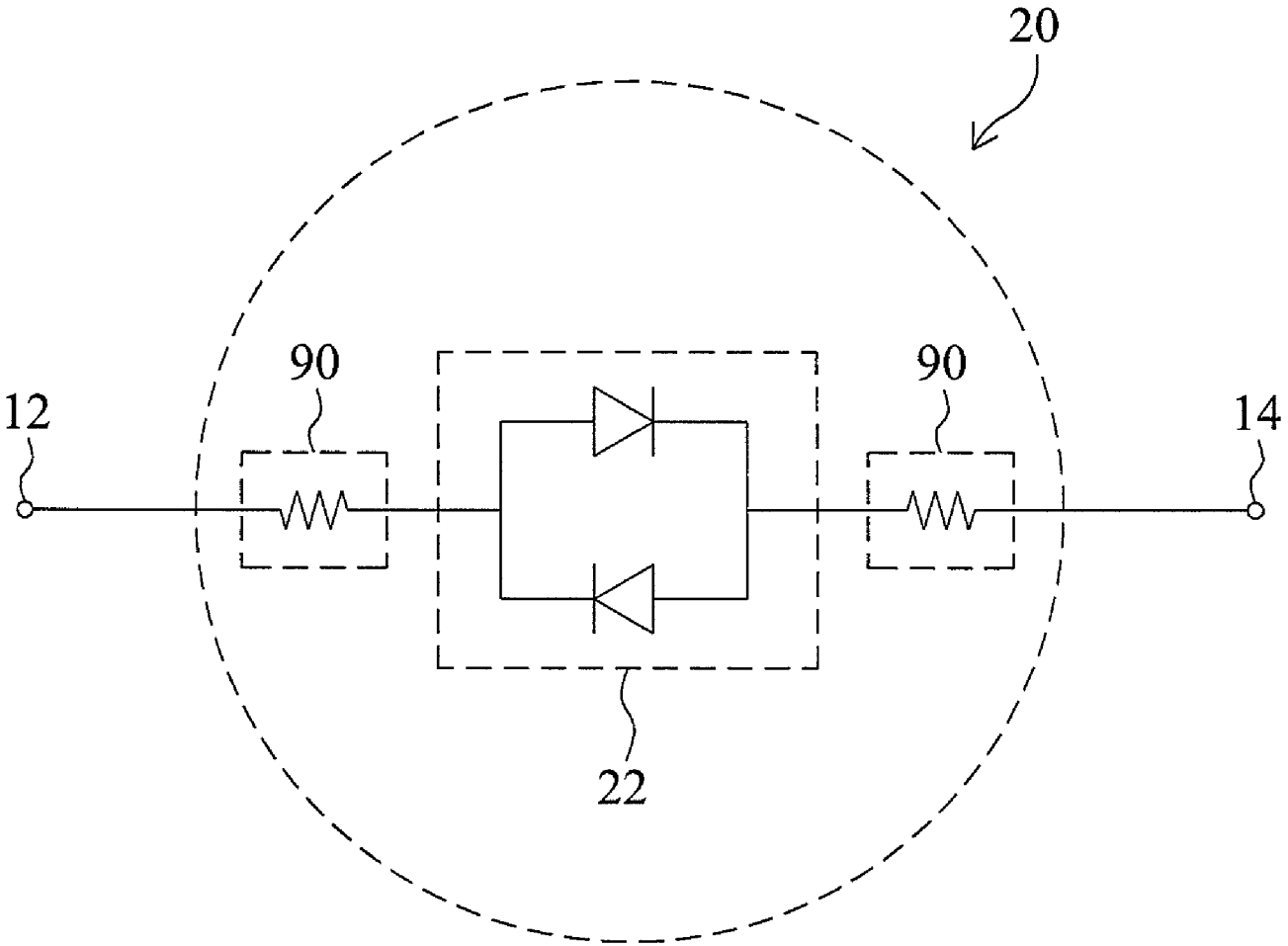
FIG. 13 shows an equivalent circuit of the structure depicted in FIG. 12.
Figure 14:
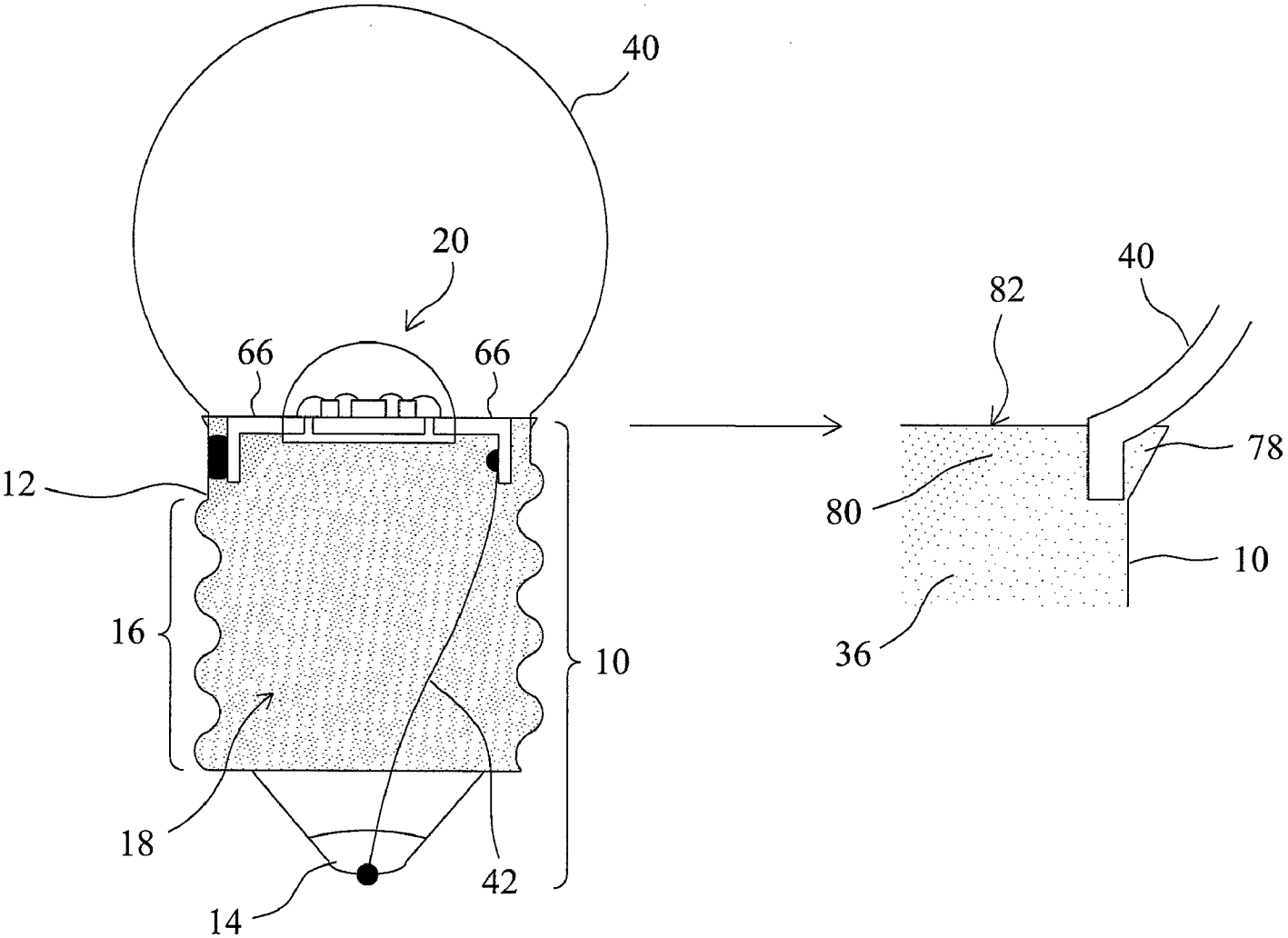
FIG. 14 is a cross-sectional view of a ninth embodiment using the structure depicted in FIG. 12.

FIG. 12 is a diagram showing a structure of packaging an AC LED epitaxial chip 22 with chip resistors 90 in a same package, in which the AC LED epitaxial chip 22 and the chip resistors 90 are attached on a pad 88, bounding wires 92 and 94 are used to electrically connect the AC LED epitaxial chip 22 to the chip resistors 90 and the chip resistors 90 to the pins 66, and an encapsulant 26 encapsulates the whole structure, whose equivalent circuit is shown in FIG. 13. Using this structure in a LED lamp, as shown in FIG. 14, the AC LED device 20 is attached on a thermally conductive electric insulator 36 filled in the cavity 18 of a lamp base 10, and has its pins 66 electrically connected to electrodes 12 and 14 of the lamp base 10, respectively. In this embodiment, fewer components are used and thus simplify the assembly process of the LED lamp. The other features are the same as those of the first embodiment shown in FIG. 1.

In the above embodiments, in general, the heat dissipation enhancement accomplished by the second portion 78 and the third portion 80 of the thermally conductive electric insulator 36 may reduce the working temperature of the AC LED device 20 by 1-5° C.

Depending on practice applications, it is selected the AC LED device 20 having a rated power ranging from 0.3 to 5 W, preferably from 1 to 3 W, and the resistor 30 preferably having a resistance ranging from 50 to 50,000Ω. In addition, it is selected the AC LED device 20 having a rated input voltage ranging from 12 to 240 V. For a LED lamp using a single AC LED device 20, the rated input voltage of the AC LED device 20 is selected to be 110 or 220 V, depending on the power lines in its application. For a LED lamp using serially connected AC LED devices 20, the rated input voltage of each AC LED device 20 is selected to be smaller, for example 12 V.

In addition to the package structures shown in the above embodiments, other types of packages may be used in a LED lamp according to the present invention.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. An LED lamp comprising:

an LED filament including an AC LED device;

a lamp base defining a cavity therein and having a first electrode and a second electrode;

a resistor electrically connected with the AC LED device in series between the first and second electrodes to form an electric loop;

a thermally conductive electric insulator filled in the cavity defined in the lamp base; and a mask bonded to the lamp base to enlarge heat dissipation area;

wherein the thermally conductive electric insulator includes a first portion mechanically contacting the LED filament and the first electrode to thereby provide a first thermal channel from the LED filament to the first electrode, and a second portion adhering the mask to the lamp base to thereby provide a second thermal channel from the lamp base to the mask.

2. The LED lamp of claim 1, wherein the thermally conductive electric insulator includes a third portion between the LED filament and the mask to thereby provide a third thermal channel from the LED filament to the mask.

3. The LED lamp of claim 2, wherein the first portion of the thermally conductive electric insulator directly contacts a bottom of the AC LED device.

4. The LED lamp of claim 2, wherein the third portion of the thermally conductive electric insulator has a white upper surface to increase light output of the LED lamp.

5. The LED lamp of claim 4, wherein the thermally conductive electric insulator comprises a titanium dioxide powder.

6. The LED lamp of claim 1, wherein the first portion of the thermally conductive electric insulator directly contacts a bottom of the AC LED device.

7. The LED lamp of claim 1, wherein the LED filament comprises a circuit board having the AC LED device bounded thereon and mechanically contacting the first portion of the thermally conductive electric insulator.

8. The LED lamp of claim 7, wherein the circuit board has an upper surface coated with a white pigment thereon.

9. The LED lamp of claim 7, wherein the thermally conductive electric insulator includes a third portion covering the circuit board and mechanically contacting the mask to thereby provide a third thermal channel from the LED filament to the mask.

10. The LED lamp of claim 9, wherein the third portion of the thermally conductive electric insulator has a white upper surface to increase light output of the LED lamp.

11. The LED lamp of claim 10, wherein the thermally conductive electric insulator comprises a titanium dioxide powder.

12. The LED lamp of claim 1, wherein the AC LED device comprises an AC LED epitaxial chip packaged with the resistor in a same package.

13. The LED lamp of claim 1, wherein the thermally conductive electric insulator comprises an epoxy resin, thermal conductor powder, or a mixture thereof.

14. An LED lamp comprising:

an AC LED device;

a lamp base defining a cavity therein and having a first electrode and a second electrode;

a resistor electrically connected with the AC LED device in series between the first and second electrodes to form an electric loop;

a thermally conductive electric insulator filled in the cavity defined in the lamp base;

a thermally conductive member have an upper end mechanically contacting the AC LED device and a lower end buried in thermally conductive electric insulator; and a mask bonded to the lamp base to enlarge heat dissipation area;

wherein the thermally conductive electric insulator includes a first portion mechanically contacting the thermally conductive member and the first electrode to thereby provide a first thermal channel from the AC LED device to the first electrode, and a second portion adhering the mask to the lamp base to thereby provide a second thermal channel from the lamp base to the mask.

15. The LED lamp of claim 14, wherein the AC LED device comprises a circuit board carrying the AC LED device and mechanically contacting the upper end of the thermally conductive member.

16. The LED lamp of claim 15, wherein the circuit board has an upper surface coated with a white pigment thereon.

17. The LED lamp of claim 14, wherein the thermally conductive electric insulator comprises an epoxy resin, thermal conductor powder, or a mixture thereof.

18. The LED lamp of claim 14, wherein the thermally conductive electric insulator has a white upper surface to increase light output of the LED lamp.

19. The LED lamp of claim 14, wherein the thermally conductive electric insulator comprises a titanium dioxide powder.

* * * * *